US008038234B2

(12) United States Patent
Weber

(10) Patent No.: US 8,038,234 B2
(45) Date of Patent: Oct. 18, 2011

(54) DEVICE FOR MOUNTING OF DRAWER FRONT PANELS

(75) Inventor: Heimo Weber, Gundelfingen (DE)

(73) Assignee: Anton Schneider GmbH & Co. KG, Kenzingen (DE)

( * ) Notice: Subject to any disclaimer, the term of this patent is extended or adjusted under 35 U.S.C. 154(b) by 469 days.

(21) Appl. No.: 12/228,891

(22) Filed: Aug. 15, 2008

(65) Prior Publication Data

US 2009/0058243 A1 Mar. 5, 2009

(30) Foreign Application Priority Data

Aug. 16, 2007 (DE) ..... 20 2007 011 518 U

(51) Int. Cl.
*A47B 88/00* (2006.01)

(52) U.S. Cl. ..... 312/348.4; 312/348.1

(58) Field of Classification Search ..... 312/330.1, 312/348.1, 348.2, 348.4, 263, 265.5, 265.6, 312/257.1; 403/321, 323, 225, 322.1, 322.4
See application file for complete search history.

(56) References Cited

U.S. PATENT DOCUMENTS

| | | | | | |
|---|---|---|---|---|---|
| 3,377,115 | A | * | 4/1968 | Hansen et al. | 312/330.1 |
| 4,226,488 | A | * | 10/1980 | Vincent | 312/317.1 |
| 4,687,237 | A | * | 8/1987 | Bisbing | 292/78 |
| 4,999,876 | A | * | 3/1991 | Nass | 16/236 |
| 5,129,341 | A | * | 7/1992 | Wang | 112/260 |
| 5,281,022 | A | * | 1/1994 | Rock | 312/348.4 |
| 5,352,034 | A | * | 10/1994 | Held et al. | 312/334.27 |
| 5,359,824 | A | * | 11/1994 | Koberstein | 52/507 |
| 5,540,515 | A | * | 7/1996 | Rock et al. | 403/322.4 |
| 5,632,567 | A | * | 5/1997 | Lowe et al. | 403/3 |
| 5,860,718 | A | * | 1/1999 | Brustle | 312/348.2 |
| 5,911,664 | A | * | 6/1999 | Masters et al. | 52/698 |
| 5,971,516 | A | * | 10/1999 | Huber | 312/348.1 |
| 6,412,893 | B1 | * | 7/2002 | Muterthies et al. | 312/348.1 |
| 6,457,791 | B1 | * | 10/2002 | Muterthies et al. | 312/348.4 |
| 6,834,918 | B2 | | 12/2004 | Park | |
| 6,969,133 | B2 | * | 11/2005 | Compagnucci | 312/334.6 |
| 6,981,752 | B2 | * | 1/2006 | Harn et al. | 312/348.4 |
| 7,318,532 | B1 | * | 1/2008 | Lee et al. | 211/26 |
| 7,857,404 | B2 | * | 12/2010 | Lam et al. | 312/348.2 |
| 2008/0315740 | A1 | * | 12/2008 | Lam et al. | 312/334.1 |

FOREIGN PATENT DOCUMENTS

| | | |
|---|---|---|
| AT | 392 400 | 3/1991 |
| DE | 90 01 484 | 4/1990 |
| DE | 200 17 059 | 1/2001 |
| EP | 0 439 748 | 8/1991 |
| GB | 2 401 305 | 11/2004 |
| RU | 2295900 | 3/2007 |

* cited by examiner

*Primary Examiner* — Janet M Wilkens
(74) *Attorney, Agent, or Firm* — Lucas & Mercanti, LLP; Klaus P. Stoffel

(57) ABSTRACT

A device for mounting of drawer front panels, which are adjustable laterally and vertically by bolts 7, 8 equipped with a thread 11 and with an eccentric, respectively, wherein the bolts 7, 8 are guided in the device 5 approximately perpendicularly to the drawer bottom and are accessible from above, wherein the threaded bolt 7 reaches through a tap hole 12 and the eccentric bolt 8 reaches through an oblong hole 16 of the device, and are supported on an undersurface 17 of the edge frame 1.

3 Claims, 2 Drawing Sheets

DEVICE FOR MOUNTING OF DRAWER FRONT PANELS

BACKGROUND OF THE INVENTION

1. Field of the Invention

The present invention relates to a device for mounting of drawer front panels.

2. Description of the Related Art

It is known in the art to adjust a device of this kind mounted in or on an edge frame and thus adjust the drawer front panel vertically and laterally by manipulating a threaded bolt and an eccentric bolt, wherein the two bolts are positioned transversely to the edge frame so that the adjustment, which usually requires the insertion of a screwdriver in a cross-shaped recess of the bolts, also has to be effected in that same direction. Therefore, in order to effect the adjustment it is necessary to reach into the drawer from the side and to place the screwdriver in a somewhat cumbersome manner, whereupon there is often not enough room between the screwdriver handle and the drawer bottom to turn the screwdriver unobstructedly.

SUMMARY OF THE INVENTION

In order to facilitate the adjustment, the bolts according to the invention are inserted approximately perpendicularly to the drawer bottom and are accessible from above, wherein the threaded bolt reaches through a tap hole and the eccentric bolt reaches through a slotted hole, and they support themselves on an undersurface of the edge frame. Thus, the lateral reach into the drawer and the lateral operation with the screwdriver is omitted, since the screwdriver can be positioned from above and can be turned free from obstacles.

In a preferred embodiment, the two bolts are positioned on the transverse element of the edge frame in a rotatable yet non-slidable manner. According to a further embodiment of the invention, a coverable opening which can be reached form above, is arranged on the edge frame opposite the bolt heads which are provided with means for engagement of a tool.

The various features of novelty which characterize the invention are pointed out with particularity in the claims annexed to and forming a part of the disclosure. For a better understanding of the invention, its operating advantages, specific objects attained by its use, reference should be had to descriptive matter in which there are described preferred embodiments of the invention.

DESCRIPTION OF THE PREFERRED EMBODIMENTS

Figure 1:
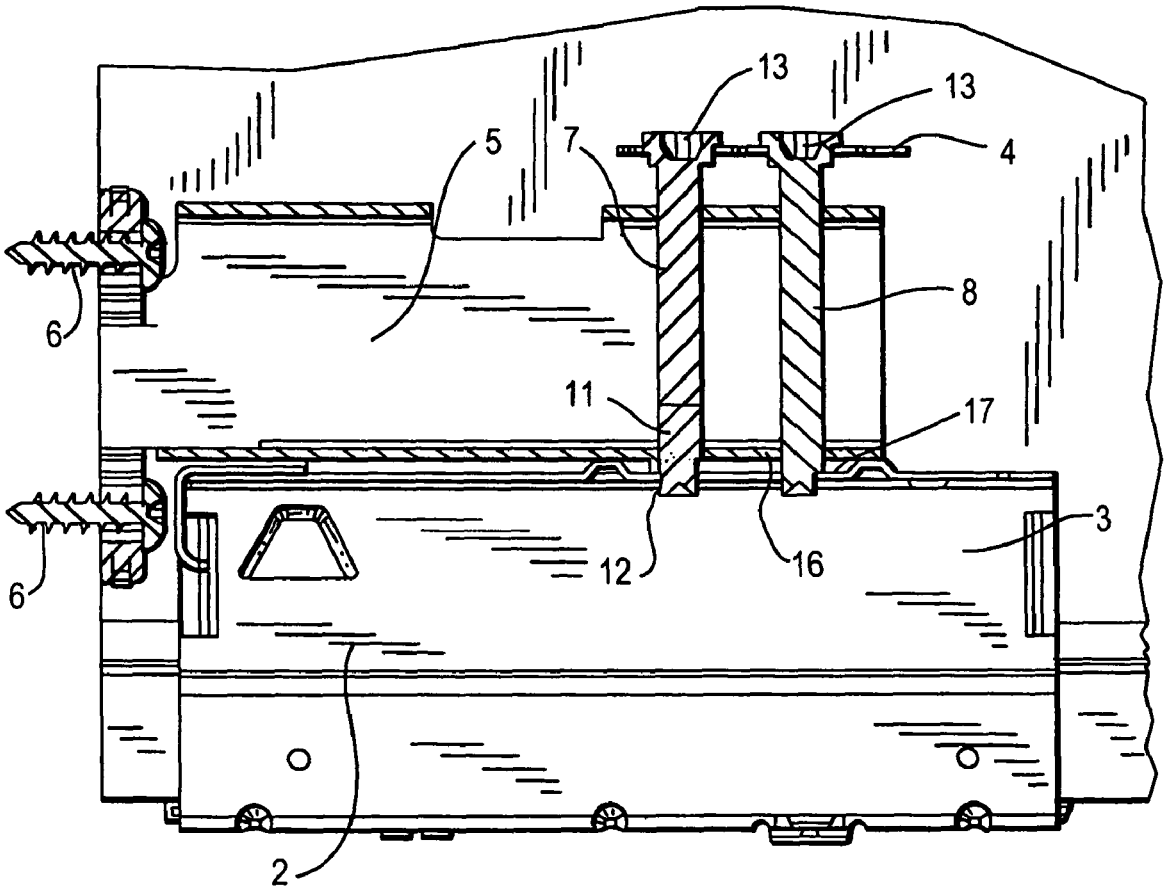
FIG. 1 is a cross-sectional view through an edge frame with a device for mounting the drawer front panel.
Figure 2:
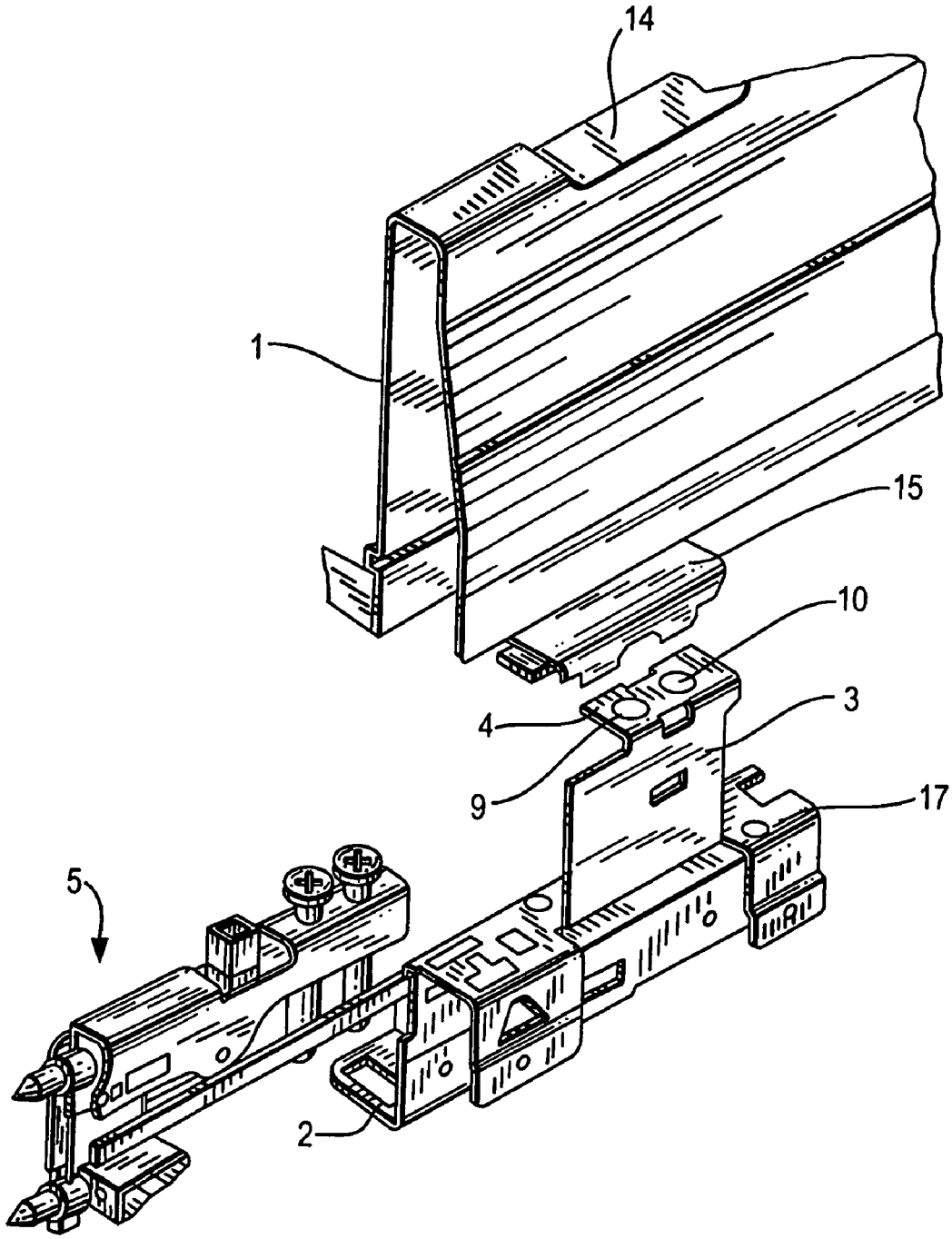
FIG. 2 is an exploded view of the frame of FIG. 1.

In the edge frame 1 a support link 2 is arranged for the guide element, not shown, of a drawer and is firmly attached to the edge frame 1. On the undersurface 17 of the support link 2 a retaining wall 3 is provided which has on its upper free end a bent portion 4. The device 5 for the mounting of a drawer front panel, not shown, is inserted into the edge frame 1, namely, between the bending 4 and the undersurface 17 of the support link 2. Thus, the device rests on the undersurface 17. At the front end of the device, two screws 6 are provided for mounting of the drawer front panel. In order to adjust the drawer front panel laterally and vertically, two bolts 7 and 8 are inserted vertically in the device 5, wherein the bolts rest on the undersurface 17 of the support link 2 in the bore holes 9 and 10 in a rotatable but non-slidable manner.

The bolt 7 is provided at the lower end thereof with a thread 11 and engages with the thread 11 in a threaded bore 12 of the device 5, whereas an oblong hole 16 is provided in the eccentric bolt 8. Both bolts 7 and 8 are provided with cross-shaped recesses 13.

In order to facilitate access to the cross-shaped recesses 13 of the bolts 7 and 8, a recess 14 is provided at the top in the edge frame 1, which can be covered with a casing 15. When the casing 15 is removed, the two bolts 7 and 8 can then be adjusted from above with a screwdriver, not shown. For the adjustment of the device 5, the bolts 7 and 8 are then moved in one or the other direction, wherein the bolt 7 effects the height adjustment and the bolt 8 effects the change in the lateral position of the device 5. After the adjustment of the bolts 7 and 8, the recess 14 can be covered with the casing 15, so that to the outside there appears a smooth continuous edge frame.

While specific embodiments of the invention have been shown and described in detail to illustrate the inventive principles, it will be understood that the invention may be embodied otherwise without departing from such principles.

The invention claimed is:

1. An apparatus for adjusting a drawer front panel, comprising: an edge frame (1); and a mounting device (5) for mounting a drawer front panel which is mounted in the edge frame and is adjustable vertically and laterally by a bolt provided with a thread and by a bolt provided with an eccentric, wherein a support link (2) for guiding a drawer is disposed in the edge frame, the support link being firmly connected to the edge frame and provided with a support surface (17), wherein the bolts extend in the mounting device approximately vertically and are accessible from above, wherein the threaded bolt reaches through a threaded hole (12) and the eccentric bolt reaches through an oblong hole (16) of the mounting device, wherein the bolts rest on the support surface (17) of the support link.

2. The apparatus according to claim 1, wherein the two bolts are positioned rotatably but non-slidably at a bent portion (4) of the support link (2) provided above the support surface (17).

3. The apparatus according to claim 1, wherein an opening accessible from above and coverable is positioned on the edge frame opposite the bolts, wherein the bolts are each provided with means for the engagement of a tool.

* * * * *